United States Patent [19]

Smith et al.

[11] 4,011,816

[45] Mar. 15, 1977

[54] CONTINUOUS LINE CONFINED DETONATING FUSE TO PROVIDE A SERIES OF WORK PULSES (U)

[75] Inventors: Vernon L. Smith; Jack F. Hecht, Sr., both of Santa Cruz, Calif.

[73] Assignee: The United States of America as represented by the Secretary of the Navy, Washington, D.C.

[22] Filed: Oct. 6, 1971

[21] Appl. No.: 187,135

[52] U.S. Cl. ..... 102/27 R; 89/1 B; 102/70 R

[51] Int. Cl.[2] ..... C06C 5/00; F42B 3/10

[58] Field of Search ..... 102/22, 27, 70 R; 89/1 B

[56] References Cited

UNITED STATES PATENTS

| | | | |
|---|---|---|---|
| 3,311,056 | 3/1967 | Noddin | 102/27 R |
| 3,382,802 | 5/1968 | Prior et al. | 102/27 R |
| 3,411,446 | 11/1968 | Michael | 102/27 R |
| 3,597,919 | 8/1971 | Lilly | 102/27 R |

*Primary Examiner*—Harold Tudor
*Attorney, Agent, or Firm*—R. S. Sciascia; Charles D. B. Curry

[57] ABSTRACT

A continuous line confined detonating fuse provides localized impulses capable of performing work. The continuous line is comprised of a metal-encased secondary explosive covered with layers of polyethylene, nylon, fiber glass and polyurethane. The gaseous by-product of the detonatable material is confined by removing a plurality of selected sections of the coverings and replacing them with elastomeric segments.

9 Claims, 6 Drawing Figures

CONTINUOUS LINE CONFINED DETONATING FUSE TO PROVIDE A SERIES OF WORK PULSES (U)

BACKGROUND OF THE INVENTION

1. Field of the Invention.

The present invention relates generally to a detonating fuse which is capable of providing a localized work pulse and more particularly to the use of a confined detonating fuse to provide a work pulse or a series of work pulses within one continuous length of fuse.

2. Description of the Prior Art

The utilization of a secondary explosive, such as found in but not limited to a Mild Detonating Fuse (MDF) encased in elastomeric or deflagrable material, is not a new procedure and has been known by practioners of the explosive art for many years. Moreover, secondary explosives have been locally encased by separate sleeving to provide localized expansion impulses to operate a multitude of mechanical contrivances. However, these encased secondary explosives are very difficult to make and do not provide confinement of the gas that results from the detonatable material in the secondary explosive. As a result, a major portion of the gaseous by-product, which provides the energy pulse, is lost and not available to perform work.

SUMMARY OF THE INVENTION

The unique detonation device, which is the subject matter of the present invention, overcomes the difficulties inherent in prior detonation devices in that it provides confinement of the gaseous by-products that result from the expansion of the detonatable material in the fuse. The device is simple to manufacture and requires few components. Briefly, the present invention comprises a metal-encased secondary explosive covered with layers of polyethylene, nylon, fiber glass polyurethane. The gaseous by-product of the detonatable material is confined by removing a plurality of selected sections of the coverings and replacing them with elastomeric segments.

STATEMENT OF THE OBJECTS OF INVENTION

A primary object of the present invention is to provide a unique method of using a detonating fuse to supply a work pulse or a series of work pulses in one continuous length.

Another object of the present invention is to provide a detonation fuse which will confine the gaseous by-products of detonation to a selected local or locals in the fuse.

Another object of the present invention is to provide a continuous length confined detonating fuse which is simple in construction and provides longitudinal strength and integrity upon initiation.

Other objects, advantages and novel features of the invention will become apparent from the following detailed descriptions of the invention when considered in conjunction with the accompanying drawings.

DESCRIPTION OF THE PREFERRED EMBODIMENT

Figure 1:
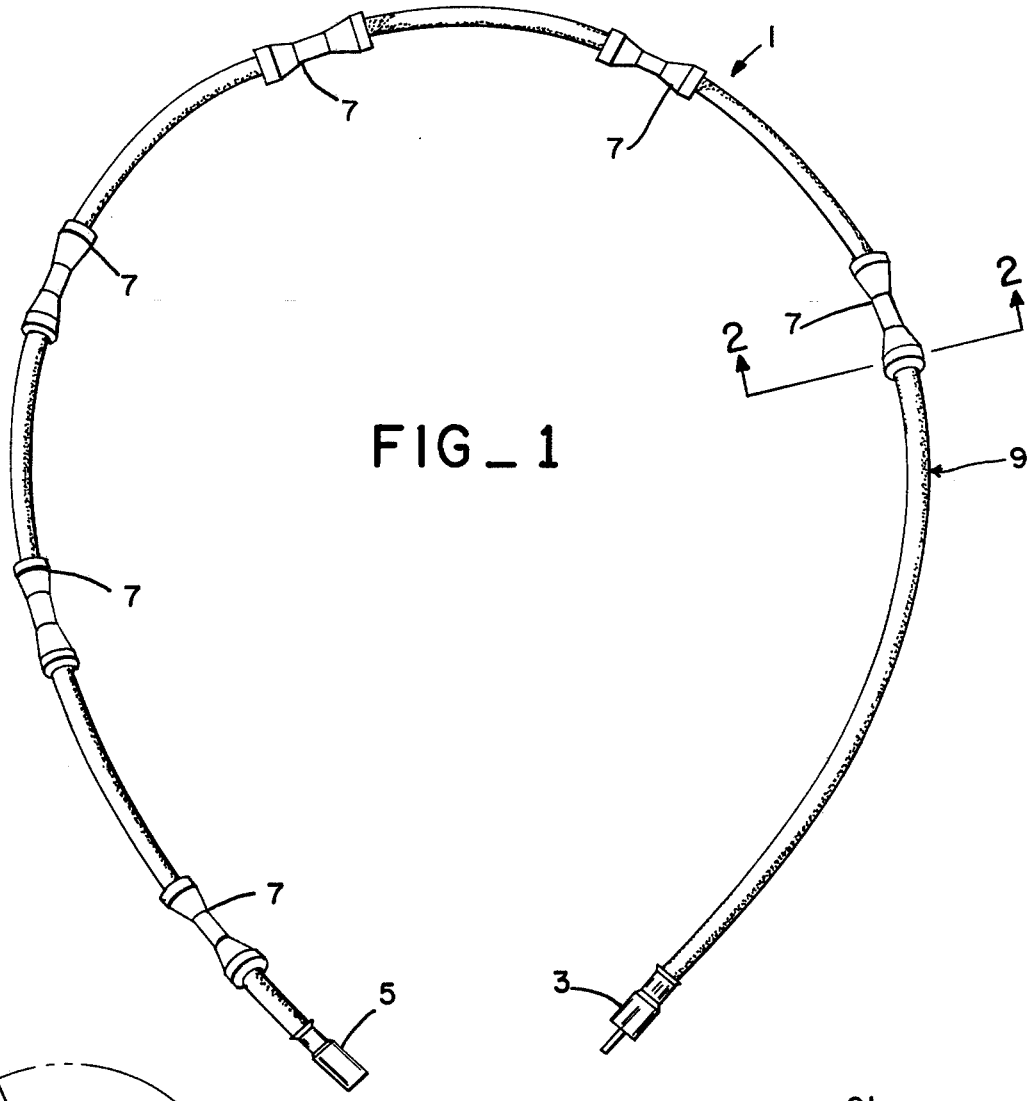
FIG. 1 is an illustration of the unique fuse with the plurality of molded elastomeric segments.

Referring to FIG. 1, the continuous length confined detonating fuse 1 includes male plug 3 and female plug 5, a plurality of elastomeric segments 7 and the encased explosive material covering 9. The segments 7 confine the gaseous by-product of the detonatable or deflagrable material within and between the encased segments 7.

Figure 2:
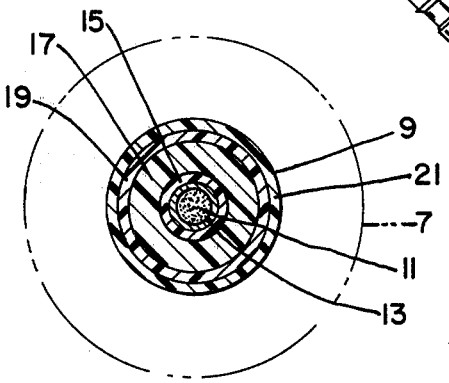
FIG. 2 is an end view of the construction of the fuse taken along line 2—2 in FIG. 1.

Referring to FIG. 2, the continuous line confined detonating fuse, shown in FIG. 1, is comprised of a secondary explosive 11, metal encasement 13, layers of polyethylene 15, nylon 17, fiber glass 19 and polyurethane 21, respectively, which form the explosive material covering 9. The confined detonating fuse 1, hereinafter referred to as CDF, is made of a metal encased secondary explosive 11 with a plurality of segments 7 located along material covering 9. The metal encasement 13 may be made of aluminum or the equivalent. The secondary explosive such as, but not limited to, cylotremethylene trinitramine (RDX) may be used for the explosive core of the detonating fuse. Covering 9, which is used to cover the metal-encased secondary explosive 11, is comprised of a layer of polyethylene 15 and a layer of nylon 17, which are further encased in seven layers of fiber glass sleeving 19 and finally enclosed with an extended sleeving of polyurethane 21 to complete the construction of CDF.

Figure 3A:
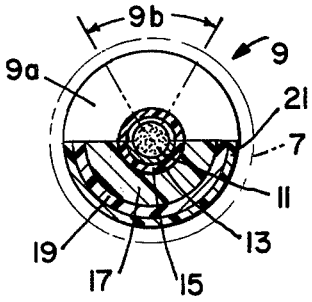
FIG. 3A is an end view of the construction of the fuse and cut-away portion taken along line 3A—3A in FIG. 3.
Figure 3:
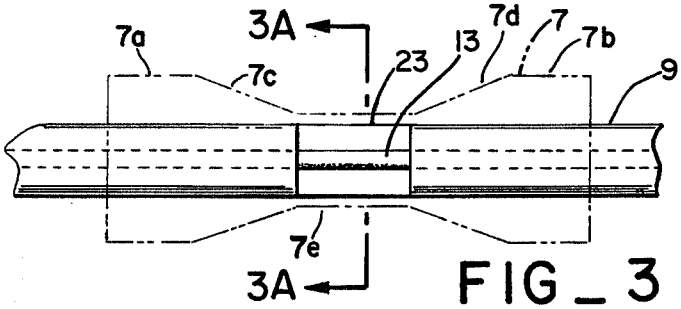
FIG. 3 is an illustration of the cut-away portion to accept the elastomeric segment of the unique fuse shown in FIGS. 1 and 2.

Referring to FIG. 3, covering 9 is removed to expose about one-half or less of metal encasement 13 to form a removed section or a gas expansion area 23. This limits and confines the expansion of the gases to the removed section or gas expansion area 23. The size of the removed section 23 may be varied to expand or reduce the gas expansion area, as illustrated by the half section **9*a* or V-wedge section 9*b* in FIG. 3A. The removed section 23, shown in FIG. 3, is then replaced with an elastomeric segment 7 which is directly molded or casted, as the case may be, into the cut-away section so that the molded material will occupy the void left by the removed sections 9*a* or 9*b* to form a filler section 8, as illustrated in FIGS. 3A and 4A. It should be noted again that the section removed should be stripped down to the metal or aluminum layer 13. Elastomeric segment 7, illustrated in FIG. 3 and 4A, is molded into a unique homogeneous spool shape with identical ends 7*a* and 7*b*, each with an adjacent inwardly tapered sections 7*c* and 7*d* contiguous to a cylindrical central section 7*e*. The removed section 23 beneath cylindrical section 7*e* defines the area of least resistance to the expanding gases while the identical ends 7*a* and 7*b*, with the adjacent tapered sections, assist 7*c* and 7*d* in retaining the gaseous expansion within the central cylindrical section 7*e*. The identical ends 7*a* and 7*b*, with the tapered sections 7*c* and 7*d*, act as rigid seals to retain the gases within the filler section 8 of the central cylindrical section 7*e*. The gaseous by-product is confined by locally removing the portion of the covering and replacing it with an elastomeric segment or segments, as described above. The molding process is repeated at several points on the fuse to form a plurality of pulse confining segments 7, as illustrated in FIG. 1. This confines the detonation to the areas between and within the segments 7**. The unique invention described above, as well as having longitudinal strength and integrity upon initiation, is very simple to manufacture.

Figure 4:
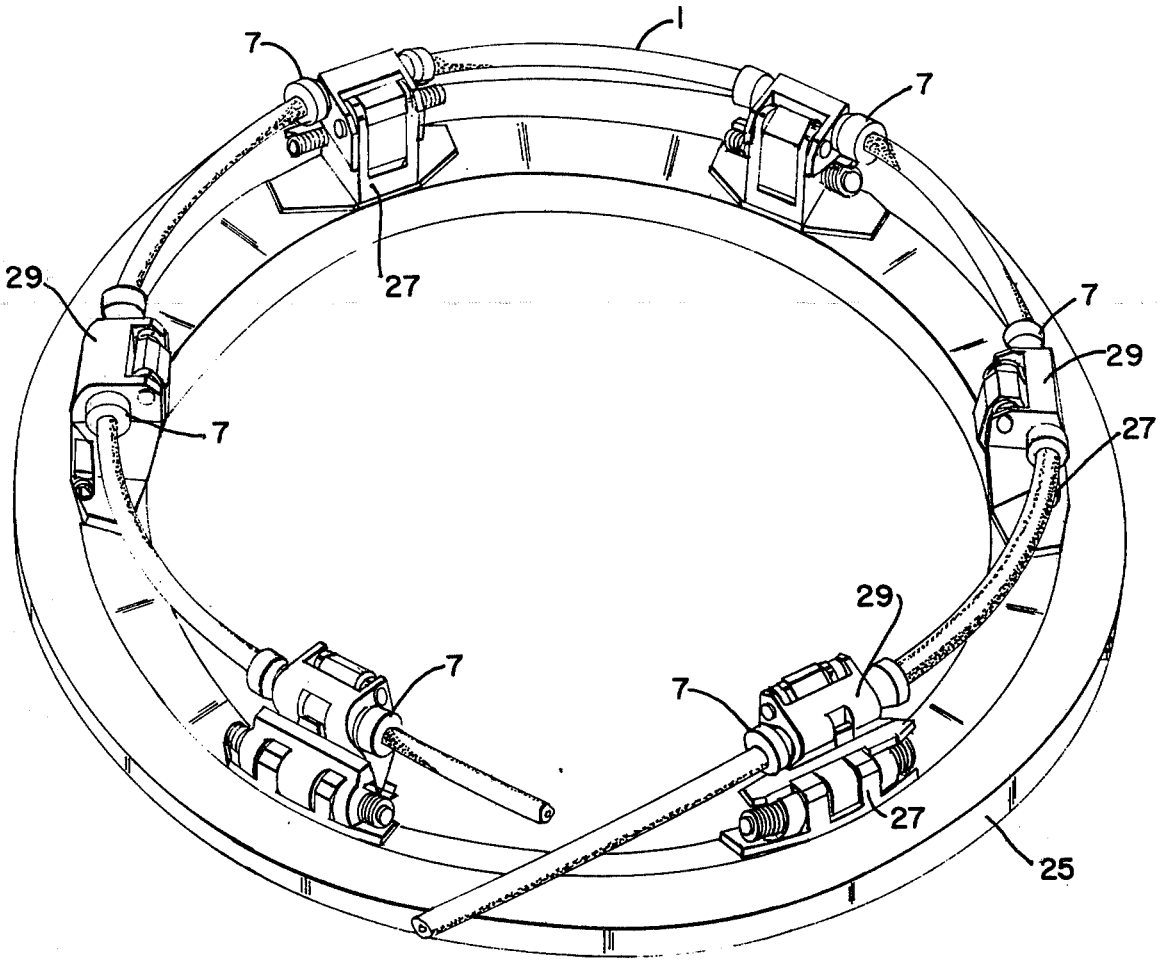
FIG. 4 is an illustration of the fuse of FIGS. 1, 2 and 3 attached to a separation release mechanism.
Figure 4A:
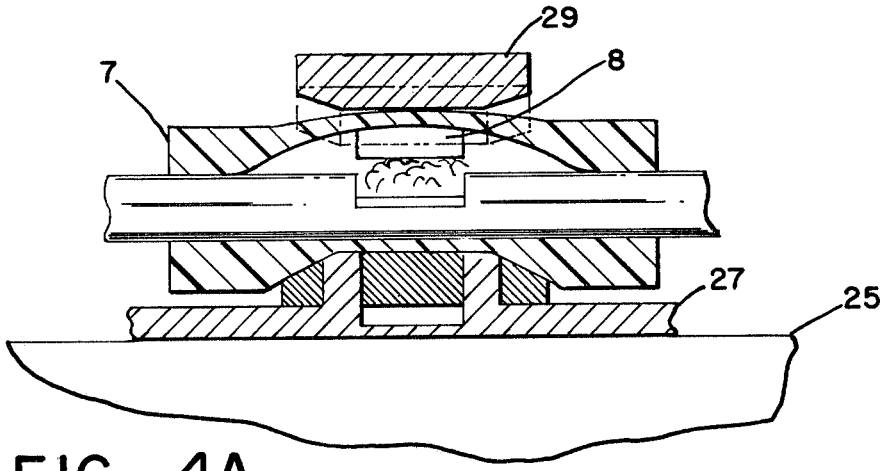
FIG. 4A is an illustration of the fuse attached to the separation release mechanism of FIG. 4.

The work to be performed may include activation of a separation release mechanism, such as the device illustrated in FIGS. 4 and 4A. The separation release mechanism 25 includes a plurality of release switches 27. The release switches 27 include a plurality of release latches 29 so that when the detonating fuse is activated, the confined gas within segments 7, which are fixedly attached to release switches 27, will activate the plurality of release latches 29. The rapid expansion of the confined gases within the filler section 8 of the removed section adjacent to segments 7 causes segments 7 to expand in volume thereby opening release latches 29, as illustrated in FIG. 4A. The use of the specific separation release mechanism, illustrated in FIG. 4, is described for purposes of showing how the fuse system can provide a work pulse or series of work pulses in one continuous fuse length. The scope of the fuse system is not limited to the aforementioned release mechanism and can be used in any system requiring the use of controlled and confined gaseous by-products to provide a work pulse or a series of work pulses.

What is claimed is:

1. A detonating fuse comprising:

a. a continuous line of metal encased secondary explosive covered with at least one layer of covering means;

b. at least one segment of said covering means being removed from said fuse thereby exposing said metal;

c. at least one detonation confining means positioned over said at least one segment, said confining means consisting of a molded elastomeric segment located and encompassing said removed segments of said coverings; whereby d. detonation of said fuse causing said at least one detonation confining means to expand outward and retain gases within said at least one segment produced by said detonation.

2. The device recited in claim 1 wherein said confining means comprises a plurality of confining means over said removed segment of said covering.

3. The device recited in claim 1 wherein a half section of said covering is removed.

4. The device recited in claim 1 wherein less than a half section of said covering is removed.

5. The device in claim 1 wherein said covering means comprises is seven layers of fiber glass sleeving and a polyurthane sleeving forms the covering.

6. The device in claim 5 wherein the said coverings are provided with a plurality of cut-away sections to accept a gaseous by-product confining means.

7. The device in claim 6 wherein said confining means is castable spool-shaped elastomeric segment designed to cover the said sections and enclose a metal encased secondary explosive.

8. The device in claim 7 wherein said secondary explosive is cyclotrimethylene trinitramine.

9. The device in claim 8 wherein said secondary explosive is confined by a plurality of elastomeric segments encompassing said secondary explosive and sequentially located along said secondary explosive.

* * * * *